US007299736B2

(12) United States Patent
Mayseless

(10) Patent No.: US 7,299,736 B2
(45) Date of Patent: Nov. 27, 2007

(54) CONTROLLED-HARM EXPLOSIVE REACTIVE ARMOR (COHERA)

(75) Inventor: Meir Mayseless, Haifa (IL)

(73) Assignee: Rafael Armament Development Authority Ltd., Haifa (IL)

( * ) Notice: Subject to any disclaimer, the term of this patent is extended or adjusted under 35 U.S.C. 154(b) by 95 days.

(21) Appl. No.: 11/003,721

(22) Filed: Dec. 3, 2004

(65) Prior Publication Data

US 2005/0211086 A1 Sep. 29, 2005

Related U.S. Application Data

(63) Continuation of application No. PCT/IL03/00487, filed on Jun. 10, 2003.

(30) Foreign Application Priority Data

Jun. 11, 2002 (IL) ..... 150145

(51) Int. Cl.
*F41H 5/007* (2006.01)

(52) U.S. Cl. ..... 89/36.17; 89/36.02

(58) Field of Classification Search ..... 89/36.02, 89/36.17; 109/49.5

See application file for complete search history.

(56) References Cited

U.S. PATENT DOCUMENTS 469,971 A 3/1892 Martin
5,114,772 A * 5/1992 Vives et al. ..... 428/49
5,824,941 A * 10/1998 Knapper ..... 89/36.17
6,021,703 A * 2/2000 Geiss et al. ..... 89/36.17
6,619,181 B1 * 9/2003 Frey et al. ..... 89/36.17

OTHER PUBLICATIONS

Results of Google search on Dec. 8, 2006; definition of the term "small caliber".*

M. Mayseless et al., "Interaction of Shaped-Charge Jets With Reactive Armor" Department of Aeronautical Engineering, Technoin, Haifa, Israel; Eighth International Symposium on Ballistics, Orlando, Florida, U.S.A., Oct. 23-25, 1984; 6 pages.

* cited by examiner

*Primary Examiner*—Stephen M Johnson
(74) *Attorney, Agent, or Firm*—Robert P. Michal; Frishauf, Holtz, Goodman & Chick, P.C.

(57) ABSTRACT

A Controlled-Harm Explosive Reactive Armor (COHERA) is made of explosive layered between two plates of material with predetermined fragmentation having controlled harm prevention properties. The fragmentation is predetermined and prevents harm to personnel and equipment nearby a reacting COHERA. The controlled harm prevention qualities of a COHERA are determined according to a Harm Specification and to accompanying harm delimiting parameters. Furthermore, the COHERA is configured to prevent sympathetic initiation.

52 Claims, 2 Drawing Sheets

CONTROLLED-HARM EXPLOSIVE REACTIVE ARMOR (COHERA)

This application is a Continuation of PCT/IL03/00487 filed Jun. 10, 2003.

TECHNICAL FIELD

The present invention relates to explosive reactive armor intended to protect personnel inside a structure protected by the explosive reactive armor from impacting enemy projectiles including various types of shaped charges. More particularly, the invention intends to alleviate the harm caused on the outside of and to the protected structure, by the fragments resulting from the explosive reaction of the explosive protective armor.

BACKGROUND ART

Explosive reactive armor for the protection of personnel residing inside a protected structure against impinging projectiles is well known to the art.

Explosive reactive armor consists of a layered explosive sandwiched between two steel plates and packages as a cassette. Armored vehicles, such as tanks, are appropriately covered, on the outside, with contiguously mounted explosive reactive armor cassettes as a measure of protection from the enemy. When a projectile impinges, preferably obliquely on the explosive reactive armor, an explosion is initiated, and a reaction occurs. The term projectile defines any kind of armor penetrating weapon, such as a kinetic energy projectile, or a hollow charge, or a shaped charge, or a high velocity slug.

FIG. 1 shows a diagrammatic cross-section of an explosive reactive armor cassette, with a front plate FP, a back plate BP, and an intermediate plate IP, or plate of explosive EX, or fast exothermic reaction composition EX. The direction of the impinging projectile is indicated by the arrow marked VP. The front plate FP faces the front F directed towards the incoming projectile and the back B indicates the opposite direction adjacent the structure protected by the explosive reactive armor.

As a result of the explosive reaction, the two steel plates, FP and BP, are accelerated in separation, in opposite directions, normal to their surface. FIG. 2 shows the direction of acceleration for both the front plate FP and the back plate BP by arrows designated as respectively $V_{FP}$ and $V_{BP}$. The translation of both plates actively interacts with the motion of the projectile, not shown in the FIGS., by crossing the trajectory thereof and hitting the projectile. Thereby, the projectile is broken and the severe perturbations that are caused, lead to a drastic reduction of the subsequent penetration capability of that projectile.

Details about the physical mechanism of projectile dispersion and deflection resulting from the operation of the explosive reactive armor are found in the reference paper entitled "Interaction of Shaped-Charge Jets with Reactive Armor", by M. Mayseless et al., Proceedings of the Eight International Symposium on Ballistics, Orlando, Fla., USA, Oct. 23-25, 1984, which is incorporated herewith in whole by reference.

Although the two steel plates of an explosive reactive armor begin their protective effect as single-piece solid plates stacked in surface abutment as a cassette mounted outside the protected structure, they shatter into fragments a few microseconds after the initiation of the explosive reaction. From this moment on, the fragments of the plates of the reactive armor develop into a life-threatening danger, scattering as shrapnel on the outside of the protected structure. Fragments from the front plate FP endanger personnel, equipment, and vehicles dwelling on the outside of the protected structure, while fragments from the back plate BP, badly damage the protected structure itself. Even though the main objective of the explosive reactive armor is achieved and the personnel inside the protected structure escapes unharmed, by-standing troops may be killed or seriously wounded, and equipment may be destroyed by fragments from the front plate FP. In addition, the back plate BP, usually abutting and contiguous to, for example, the armor of an armored vehicle, may inflict so much damage as to render it unfit for service.

Furthermore, the contiguously mounted steel plates of the explosive reactive armor cassettes support sympathetic initiation, whereby the explosive reaction of one explosive reactive armor cassette triggers the reaction of neighboring cassettes, causing an unnecessary reaction, and thus waste, of a number of such protection cassettes.

It is thus desirable to provide a solution to prevent or mitigate the harm caused on the outside of the protected structures to nearby troops and to equipment, when an explosive reactive armor scatters fragments. This solution is also necessary to prevent damage to the protected structure itself, but the beneficial protective effect of the explosive reactive armor must be retained.

Moreover, sympathetic reaction is detrimental to the degree of protection of the protected structure and requires repair time for replacement of the spent protection cassettes. Therefore, sympathetic reaction is preferably prevented.

Prior art solutions for the protection from harm inflicted by the fragments resulting from the explosion of an explosive reactive armor are not known to have been disclosed.

DISCLOSURE OF THE INVENTION

An Explosive Reactive Armor, or ERA, is configures as a sandwich of explosive layered between two steel plates. Although an ERA effectively reacts to protect structures against incoming projectiles, it simultaneously scatters lethal fragments endangering nearby personnel and equipment.

To mitigate this danger, the fragmentation properties of the steel plates is predetermined by configuring them for controlled scattering into harmless fragments.

SUMMARY

It is an object to provide a method and a device operative as a controlled harm explosive reactive armor (COHERA) with a stack of plate elements having a front plate, an intermediate plate providing a fast exothermic reaction, and a back plate, the stack of plate elements reacting explosively to disrupt the trajectory of and/or to break an incoming projectile impinging on the front plate. At least one plate out of the stack of plate elements, such as the front plate and the back plate, is configured to shatter in predetermined fragmentation for controlled harm prevention when the COHERA reacts explosively, whereby the COHERA forms an explosive reactive armor cassette for controlled harm prevention.

At least either one of both, the front plate and the back plate is configured to shatter in predetermined fragmentation for controlled harm prevention when the COHERA reacts explosively, and the intermediate plate has at least one layer of explosive or one layer of propellant.

It is another object to create, upon explosive reaction of the COHERA, a predetermined fragment distribution configured for controlled harm prevention that is obtained by appropriate material selection for providing necessary fragment properties, which are selected alone and in combination, from the group of properties consisting of fragment weight, fragment density and fragment shape.

A further object is to provide a COHERA wherein each one plate element has at least one layer having a certain thickness, including a layer substance and a layer thickness selected to provide predetermined fragmention for controlled harm prevention when the COHERA reacts explosively. Furthermore, the plate composition for each one plate element is independent of the plate composition for each one other plate element, with respect to a property selected alone or in combination from the group of plate properties consisting of number of layers, sequential order of layers, and thickness of layers.

It is understood that at least one plate element has one or more than one layer of material. Such a layer is possibly a layer of air disposed, either backward of the frontmost layer of the front plate or in front of a backmost layer of the back plate. Moreover, each plate may have thermal insulation properties. Each plate element is configured to prevent initiation in sympathetic reaction by being selected, alone and in combination, from the group of plate material properties consisting of material type and material density.

One more object is to provide a COHERA wherein the at least one layer of either one and of both the front plate and the back plate is configured to provide insensitivity to initiation by small caliber ammunition and by shrapnel by being selected, alone and in combination, from the group of layer material consisting of layer material type and layer material density.

It is yet another object to provide a COHERA configured to comply with at least one Harm Specification (HAS) including a criterion related to an effect resulting from the explosive reaction for harm prevention of the COHERA, and at least one first index defining a parameter related to the at least one HAS. It is also possible to provide a plurality of indices further including parameters related to additional effects resulting from the explosive reaction of the COHERA. Such a HAS and indices may be configured to comply with a criterion having at least one parameter represented as a cell selected from a matrix of m times n cells formed by rows of HAS spanning from 1 to n in perpendicular to columns of index parameters ranging from 1 to m. Each one front and back plate may comply with at least one cell of the matrix, being the same or a different cell, and even with more than one cell.

Still another object is to provide a method for implementing a controlled harm explosive reactive armor (COHERA) cassette having a stack of plate elements including a front plate, an intermediate plate providing a fast exothermic reaction, and a back plate that explosively react to disrupt the trajectory of and/or to break an incoming projectile impinging on the front plate. The method comprises the steps of configuring at least one plate out of the stack of plate elements to shatter in predetermined fragmentation for controlled harm prevention when the COHERA reacts explosively, whereby the COHERA forms a predetermined fragmentation explosive reactive armor cassette for controlled harm prevention.

It is also an object to provide a predetermined controlled distribution of fragment size, fragment range and fragment shape when the COHERA reacts explosively to ensure the prevention of harm.

BRIEF DESCRIPTION OF THE DRAWINGS

In order to understand the invention and to see how it may be carried out in practice, preferred embodiments will now be described, by way of non-limiting example only, with reference to the accompanying drawings, in which.

DESCRIPTION OF PREFERRED EMBODIMENTS

Figure 1:
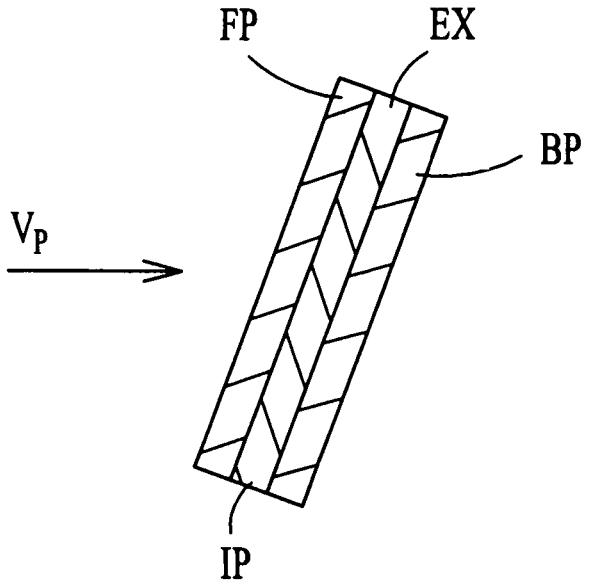
FIG. 1 is a cross-section showing the elements of an explosive reactive armor cassette.

The danger presented by fragments from a front plate FP of an explosive reactive armor, upon explosive reaction, and the harm they may cause when hitting personnel or equipment, is alleviated by providing either protection against the fragments or by rendering the fragments harmless. The latter is feasible when considering that shattering of a plate takes place only a few microseconds after the initiation of the intermediate plate IP, or plate of explosive EX (see FIG. 1). More important, shattering occurs during or after the mass flux liberated by the explosive reaction has already effectively defeated the penetration capability of the projectile impinging on the explosive reactive armor. These considerations lead to the concept of explosive reactive armor plates effectively protecting the crew inside a protected structure against impinging projectiles, while at the same time, being shattered into harmless fragments on the outside of the protected structure.

Typically, harm is caused by high pressure, such as by an impacting fragment having, for example, a high velocity, a high density, a high speed of sound in that fragment, and low aerodynamic drag. The opposite, here the prevention of harm, requires the contrary qualities, such as low impact velocity, low density, low speed of sound and high drag. A plate made of compacted sand provides an example. That plate may be designed for low initial velocity, shattering into miniscule sand grains of low weight, with sand featuring low density, and high drag coefficient for fast deceleration. Such a plate will provide a fragment distribution for preventing harm with predetermined fragment weight, fragment density, and fragment shape.

The issue is thus one of commanding control over the physical properties of the plates of the explosive reactive armor. That commanding control has for aim to render the fragments harmless. The term harmless, or safe, will be described below.

A plate may pulverize into a myriad of safe miniscule fragments, or break down in large lightweight harmless parts, since it is possible to appropriately select the material and the thickness of the plate. It becomes thus possible to exercise control over the harm inflicting qualities of these controlled-harm fragments. This harm-controlled fragmentation of the plates paves the way for the implementation of Controlled Harm Explosive Reactive Armor, or COHERA. The aim is to mitigate the level of harm possibly inflicted by the fragments. It is noted that the name COHERA has nothing in common with the Controlled Fragmentation of Ammunition, known as COFRAM.

It is easy to accept the idea of harmless fragments when considering materials such as gypsum, hardened sand, and sintered material parts, since all of them started as some kind of powder before being shaped, say into a plate. Understandably, a violent explosive reaction is a simple way to pulverize a brittle material into a harmless cloud of miniscule fragments. The question to debate regards the retention of the protective characteristics of the plates related to the breakage and deflection of the incoming enemy projectile.

According to the equations presented in the above-cited reference paper, the influential physical coefficient responsible for the breakup and deflection of an incoming projectile from its trajectory is the mass flux introduced into the zone of interaction with the impacting projectile. Hence the mass, i.e. the density of the material of the front plate FP, and of the back plate BP, and their thickness, as well as the speed of these plates, are of major importance for successfully defeating the incoming projectile. Similarly, adding to the thickness of the intermediate reactive plate IP increases the speed of separation of both the front plate FP and the back plate BP, thereby increasing the mass flux.

In current prior art practice, the actual thickness of a steel plate spans between 1 mm to 10 mm, depending on the diameter of the expected incoming projectile against which the explosive reactive armor is designed. As an example, one type of explosive reactive armor is designated as the "3-3-3" type, meaning that the front plate FP, the intermediate plate IP, and the back plate BP are all three mm thick. The material of the front and back plates, respectively FP and BP, is mild steel and the explosive plate EX consists of C4 explosive. The addition of a few millimeters or even of two or three centimeters of thickness of material, if necessary at all, is certainly tolerable. Actually, the thickness is not a limiting factor and is easily implemented. In parallel, the thickness of the plate of explosive EX is possibly increased to augment the acceleration of both the front plate FP and the back plate BP, and to boost the mass-flux provided by those plates.

Intuitively, mass-density and shattering into miniscule fragments are compatible when plates made of sintered material are considered. Powders of metal of high mass-density are readily available on the market and a binding matrix may be chosen to respond to the required shattering parameters imposed on the COHERA. For example, sintered powder of metals such as tungsten, steel, and aluminum, may provide plates of compatible mass density per unit area, which the reaction of the COHERA will easily return to powder.

Materials such as glass also fulfill the harm prevention criteria, or predetermined shattering parameters, intuitively connectable to the crash of a drinking glass into a myriad of splinters. For example, one kind of glass candidate for the task is doron, a layered glass cloth impregnated with a hard plastic which features advantageous properties.

The use of glass as one of the plates for an explosive cassette of reactive armor, but for a different purpose, was mentioned in U.S. Pat. No. 5,824,941 disclosed by and referred to below as Knapper. To provide protection against a penetration projectile over an extended period of time, Knapper divulges a sequence of reactive armor cassettes for, column 1, lines 34-35, ". . . defense against the jets from hollow charges over a relatively lengthy period of effectiveness.", providing ". . . sequential detonations over a period of time . . . ", column 3, line 31. Knapper's embodiment consists of a sequence of boxes where ". . . a steel plate is always located opposite a glass plate, . . . "column 1, lines 45 to 46. The reason for the use of glass is that Knapper wants to prevent interference of a front plate with the reaction of a "trailing plate", thus a back plate of a preceding cassette, against an impinging projectile. Since Knapper teaches a succession of parallel explosive reactive armor cassettes, a reacting front plate from one cassette might interfere with the projectile-deflecting ability of the back plate of a preceding reacting cassette. To this end, the explosive reactive armor cassettes are fitted with a glass front plate and with a steel back plate, as Knapper realized that, by column 2, lines 25 to 28, "The glass plate . . . disintegrates into dust, and disturbs the hollow-charge jet 20 only to a minor extent".

The advantages of the glass plate, as cited by Knapper in column 3, lines 17 to 21, ". . . affords an essentially lower resistance to the hollow-charge jet 20 than does the steel plate 13, . . . " and ". . . it provides the countermeasure for the steel plate 13 which is to be accelerated in parallel." Knapper states "countermeasure" but what is meant is "backup".

The motives of Knapper are logical: to provide backup to the explosive reactive armor while preventing the reacting front plate from one cassette from interfering with the reactive effect of the steel back plate from the preceding cassette. In contrast, the present invention also takes advantage of plates of glass, but for a totally different purpose, without diminishing the protective effect of the stand-alone explosive reactive armor cassette.

As a simplified example, in parallel to the above-mentioned prior art explosive reactive armor of the "3-3-3" type, one may consider a COHERA designated as a "10-9-15" type. In this case, the front plate FP is 10 mm thick, the back plate BP is 15 mm thick, and both are made of fiberglass. The intermediate plate IP consists of a 9 mm thick plate of C4 explosive.

Besides sintered materials and glasses, the required harm preventing predetermined shattering properties are also shared by plastics and rubber containing a measured amount of fillers such as powders or filaments, or even without any addition. In fact, besides solid iron or mild steel used with conventional explosive reactive armor, it is possible to produce plates that respond to COHERA shattering criteria from compositions containing almost any material.

The predetermined fragmentation, thus the number, the size, and the shape of the fragments into which a COHERA shatters may be of secondary importance only. What finally counts is the harm caused by the fragments, such as body injuries or damage to equipment, and again, not their number, or their size, or their shape. It is therefore acceptable for a plate to "shatter" into one single fragment, thus not to disintegrate at all, after the explosive reaction of the COHERA, if a required criterion or harm prevention specification is met relative to the safety of personnel or the integrity of equipment. However, it is understood that the fragments of a COHERA are predetermined in the sense that they comply with a criterion, or specification, chosen for controlled harm prevention.

Conventional explosive reactive armor is designed in response to a given criterion of penetration of an impinging projectile, which is in fact a penetration prevention criterion. The given penetration prevention criterion represents the qualities that defeat the penetration ability of different kinds of projectiles. In the same manner, a COHERA is designed as an explosive reactive armor according to a predetermined and controlled harm prevention specification, or harm specification. The harm specification represents the quality to controllably prevent harm inflicted by the fragments to the surroundings when the COHERA reacts explosively.

A criterion for specific controlled harm prevention quality of a COHERA is called a Harm Specification, or a HAS. Since the purpose of the present invention is to control the danger related to the fragments of the COHERA and to prevent the infliction of harm, a specific HAS may be dedicated to each kind of harm. A HAS may be accompanied by one or more parameters delimiting the harm.

For example, a first HAS, may relate to harm inflicted by fragments to personnel hear an explosively reacting COHERA. The degree of severity of that harm from those fragments may span from the extreme, i.e. death, through a series of degrees of severity covering critical wounds, medium degree casualties, light injuries, superficial wounds, and terminate with no injuries at all. The actual distance of the personnel from the explosively reacting COHERA must also be taken into account since evidently, fragments of a COHERA that are lethal close-by to the explosive reaction, become totally harmless at a given distance.

A harm criterion relating to personnel outside a COHERA-protected structure may thus be designated as a first HAS, or HAS 1, and may thus comprise, for example a first index, or index A, delimiting the degree of severity of the injuries, a second index, or index B, stating the distance from the explosively reacting COHERA, and so on. Many more additional indices are evidently possible.

A designer may thus be confronted with the task to devise a COHERA responding to a first HAS for the prevention of bodily harm, according to a delimitation set by a first index and a second index to that first HAS. The first index to the first HAS, may require, for example, not more than superficial wounds. The second index to the first HAS, is perhaps taken in relation with troops at a distance of not less than a predetermined number of meters away from the explosively reacting COHERA. A HAS is thus a control parameter of the harm.

A second illustration deals with the damage to equipment. For example, a second HAS, or HAS 2, may indicate damage caused by fragments to equipment near an explosively reacting COHERA. The degree of severity of the damage may span from the extreme, i.e. total destruction or out-of-use condition, via a range covering several degrees of damage, from medium to light, down to no damage at all. The distance of the equipment from the explosively reacting COHERA is important since evidently, the farther away, the less damage. A harm criterion such as a second HAS may thus relate to damage to equipment outside the structure protected by the COHERA, with a first index to the second HAS, defining the degree of severity of the damage, and a second index to the second HAS, delimiting the distance from the explosively reacting COHERA. As above, these two indices, namely the first and second index to the second HAS, selected according to operational requirements or to other decision, are a harm limiting, or harm control specification imposed on the performance expected from an accordingly designed COHERA.

A last example refers to a situation involving an armored vehicle on which the COHERA is mounted for protection against enemy projectiles. When the back plate BP of a conventional explosive reactive armor cassette bursts into fragments, extensive structural destruction is inflicted to the protected structure, but the crew is secure. For a COHERA then, it is an object not only to protect the crew, but also to limit that extensive structural destruction. In the same manner, it is practical to mount appropriately designed COHERA cassettes on various kinds of vehicles, including light boats and helicopters.

A third HAS, or HAS 3, may relate to harm inflicted to a protected structure, with a first index to the third HAS delimiting the degree of severity of that damage as a result from the explosive reaction of the COHERA. For example, requiring retrieval from service, repair in a facility, or repair in situ.

A second index to the third HAS may state the time needed for repair of the impairment of the vehicle, and further indices may relate to the level of the maintenance facility able to make the repair, and to the cost of the repair. In this last example, the distance of the protected structure from the COHERA is not considered, as the COHERA is usually mounted directly onto the vehicle. Evidently, a protected structure is not necessarily an armored vehicle since the options are open to all kinds of vehicles and various types of buildings and static constructions. Vehicles include airborne, seagoing, and terrestrial means of transportation.

It is not possible to define harm as a single quantitative value for the simple reason that many definitions exist for harm and that those definitions differ from country to country. Furthermore, there are evidently many types of harm, as was described above. In the past for example, a fragment carrying the energy of 80 joules or more was defined as causing harm, but with time, this definition has also changed. It is thus unpractical to fix a numeric harm criterion.

Figure 3:
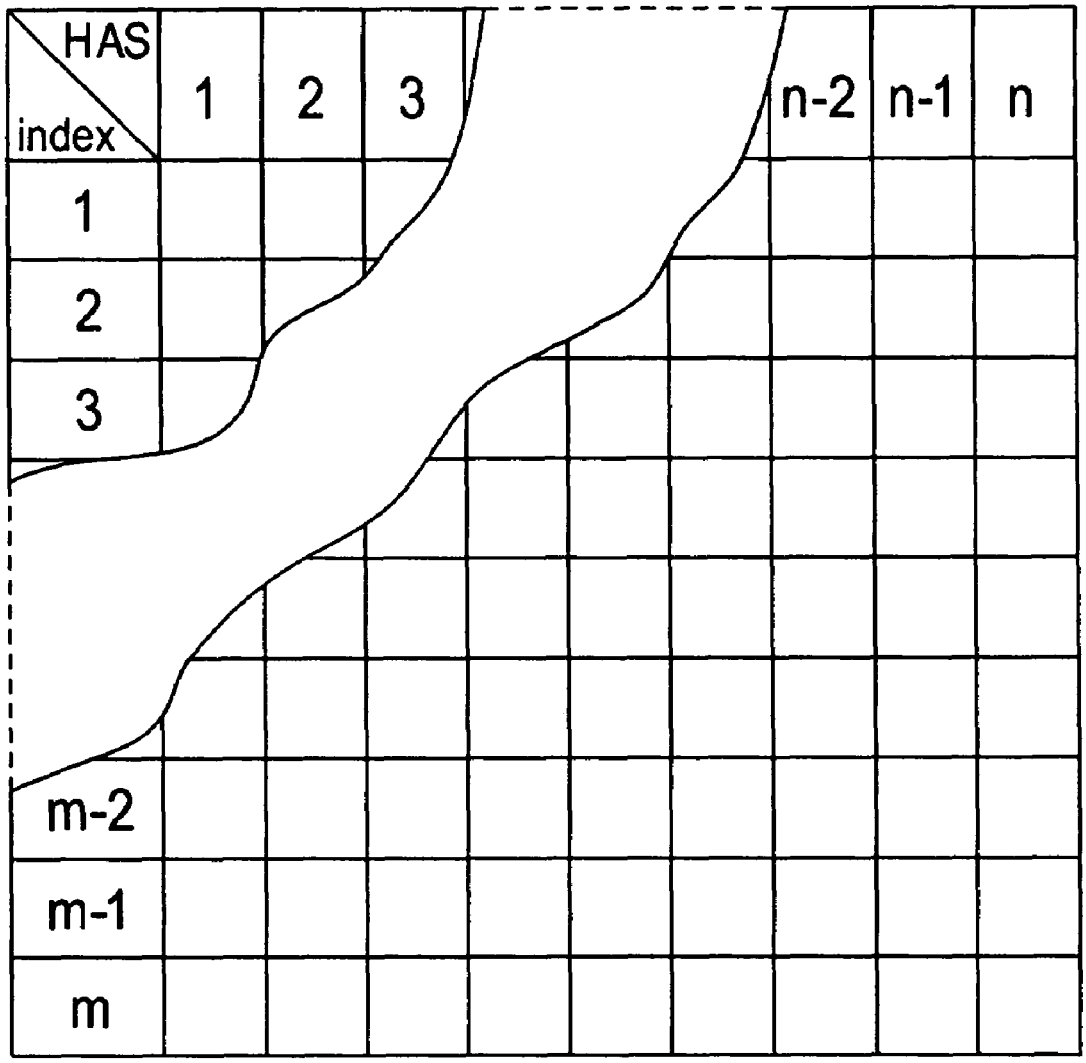
FIG. 3 is a matrix of criteria applicable to a cassette as illustrated in FIG. 1.

A HAS is thus a specific criterion possibly carrying indices, combining indices or without indices, as long as the one or more conditions for the prevention of harm is or are unambiguously defined and allow a COHERA to comply therewith. The COHERA is made to comply with at least one single HAS or with many HAS criteria. With reference to FIG. 3, there is shown a matrix of cells with HAS criteria spanning in rows from 1 to n, and with indices running in columns from 1 to m, from which at least one cell is selected for a COHERA. The matrix of FIG. 3 provides a field of selection of criteria and indices for a COHERA as a whole as well as for a front plate FP and for a back plate BP.

In the same manner as a criterion and indices are selected for each plate alone or for both plates together, the structure of a front plate FP may differ from the structure of a back plate BP or be identical therewith. The issue is dependent on the desired control of harm prevention requirements and results.

By a first mechanism, harm caused by a fragment impacting on a surface is proportional to the kinetic energy of that fragment, thus to the multiplication of the mass by the square of the velocity. To prevent harm, there is thus required a low mass, or a low velocity, or both or a combination of low mass times velocity to the square. As described above, a plate of sintered metal powder pulverizing into particles will propel only fragments of minor mass and therefore, cause little or no harm at all.

Figure 2:
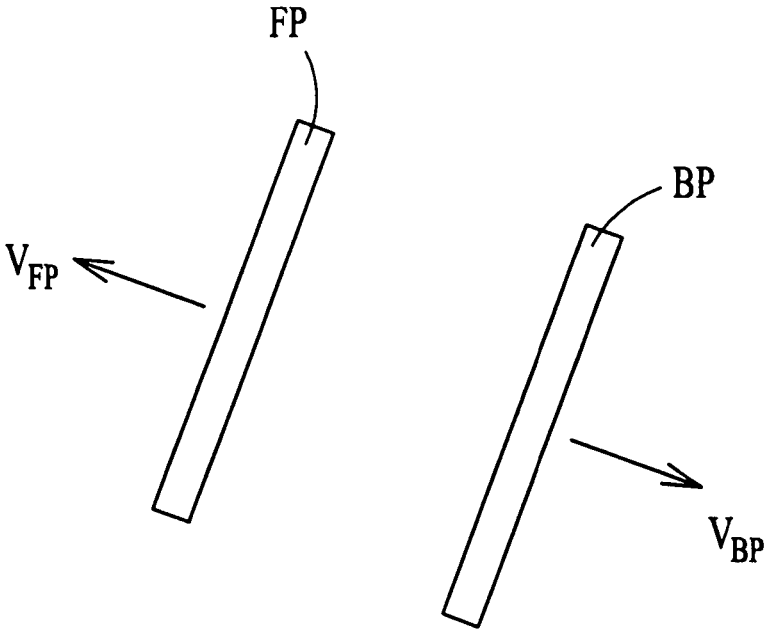
FIG. 2 depicts the cassette of FIG. 1 after the reaction.

Another way to prevent harm is to have plates made of lightweight plastic material, to burst into a single fragment, i.e., a whole plate, as an extreme example. Being thrown by the explosive reaction in perpendicular to the surface of the plate, as shown in FIG. 2, thus with the maximum coefficient of drag, the velocity of the plate diminishes abruptly, quickly loosing energy. In addition, the low density of the plastic contributes to the lowering of the pressure on the impacted surface.

A second mechanism of harm calls for a high surface pressure on the impacted surface. In response, the prevention of harm is obtained by ensuring low surface pressure, by fast decelerating fragments with a large contact plane, made from a material with a low density featuring a low speed of sound.

A designer is thus presented with various ways to control, reduce and prevent the harm generated by the predetermined fragmentation of an explosively reacting COHERA, enabling compliance with one or more harm prevention criteria.

A practical consideration when making the plates of a COHERA is the need to comply with the required ability to endure the harsh environmental conditions imposed by the battlefield on military equipment. This means that shock, impact, extreme temperature and other climatic parameters and warfare conditions must all be met by the material chosen as a plate for a COHERA. Some of the materials from which a choice is possible are, for example, since many more possibilities are practical, ceramics, plastic materials, cermets, doron, fiberglass, polycarbonate, and fiber composite materials such as Kevlar™, (Kevla is a registered Trade Mark), and powder compacted materials.

It is noted that a plate, either a front plate FP or a back plate BF, is not necessarily monolithic, but may consist of layers of the same or different materials, or of a combination of materials. Each layer has a thickness, but material and thickness of all the plate elements, i.e. front, intermediate and back plates, respectively, FP, IP, and BP of the COHERA must comply in whole, as a system, with the chosen criterion for controlled harm prevention. A plate may be defined by a plate composition having a number of layers, a certain sequential order of layers, and a layer thickness.

In this context, a layer of air is also viewed as a valid layer, as long as it is not the frontmost layer in a front plate FP or the backmost layer in a back plate BP.

The different ways for the possible implementation of a plate may thus include layers of various materials, where each material fulfills a specific role. For example, a front plate FP with three layers of materials may include a sequence of layers, made of doron, air, and aluminum, referred to hereafter, correspondingly, as the exterior layer, the middle layer, and the interior layer. Possibly, the interior layer resting on the explosive may be made of a chosen alloy of aluminum, to provide a rigid backup against the layer of explosive EX, (see FIG. 1) but will shatter in harmless fragments. A middle layer of air may serve as a heat insulator. Finally, the exterior layer produced from doron, may be selected to stand up to harsh combat zone conditions, and disintegrate upon explosive reaction into minute harmless fragments.

When deciding about a single or more materials for the front plate FP, it is advantageous to consider heat transfer properties. It is well known in the art that chemical compositions for fast exothermic reaction are sensitive to temperature, which involves a safety issue since sensitive explosive is much more susceptible to initiation. It is appreciated that the term "chemical composition for fast exothermic reaction" is generic and applies to propellants and to explosives. A higher temperature lowers the level of the impact shock required for initiation of the COHERA, while low temperatures make it more difficult to initiate an explosive reaction. Therefore, plates for a COHERA provide additional advantages if they may also serve as insulating material against low, or high, or extreme ambient temperatures. In general, the coefficient of thermal conductivity of a plate is preferred to be comparable to that of plastic materials and glass, rather than that of metal.

It is thus evident that the construction of the front plate FP and of the back plate BP are possibly different and may carry a different HAS number, although both the front plate FP and the back plate BP may be identical and carry the same HAS number.

Sympathetic reaction is another important characteristic distinguishing between conventional explosive reactive armor and COHERA. It is well known that upon impact with and/or reaction of an explosive reactive armor cassette, the steel plates of that cassette may transmit the created shock waves to contiguous cassettes initiating therein interactive explosive reaction. Contiguous cassettes are thus initiated without any projectile impinging thereon, thereby starting a detrimental "domino effect" by which many explosive reactive armor cassettes are wasted uselessly. Not only is the protected structure left with gaping holes in its blanket of protection but the cost and the time, wasted for the replacement of those cassettes, are substantial.

With COHERA, assuming for example plates of a material type such as composite plastic material, the homogeneous shock-propagating medium of steel plates having high material density and high speed of sound has disappeared. Plastics and sintered materials, and for example composite plastics, dampen shocks and prevent the propagation of sympathetic chain reaction.

A fourth HAS, or HAS4, may indicate the resistance to sympathetic explosion. A first index to the fourth HAS may refer, for example, to the number of COHERA cassettes reacting sympathetically in response to the reaction of a first COHERA cassette initiated by an impinging projectile. It makes no difference whether the reaction is an explosion or a deflagration. Accordingly, the first index to the fourth HAS may range from zero to an ascending range of integers, with zero being the criterion whereby sympathetic explosion is totally absent, and the integers referring to the number of sympathetically initiated cassettes.

Clearly, both conventional explosive reactive armor and COHERA cassettes may cover a protected structure, either static or mobile, should an advantage be found to such a mix.

Small ammunition bullets and shrapnel sometimes initiate explosive reactive armor by impinging on the steel front plate FP. Such a phenomenon is mostly improbable if not at all impossible with COHERA where the front plate is made for example, of composite material that dampens the propagation of shock waves. Layer material and layer density thus alleviate the problem of unwanted initiation. It is thus possible to set an additional HAS criterion regarding sensitivity or inertness to small caliber and fragment impact in relation to COHERA reaction initiation, with an index indicating the level of that sensitivity. As stated above, it is irrelevant whether the COHERA reacts by detonation or deflagration since the result is one or many wasted protective cassette(s).

In practice, COHERA cassettes may be mounted on the outside of a protected structure by any of the mechanical fastening means known in the trade. For mounting purposes, there is practically no difference at all or perhaps only minor difference between the mounting of COHERA and of conventional cassettes. It will be appreciated by persons skilled in the art, that the present invention is not limited to what has been particularly shown and described hereinabove. Rather, the scope of the present invention is defined by the appended claims and includes both combinations and sub-combinations of the various features described hereinabove as well as variations and modifications thereof which would occur to persons skilled in the art upon reading the foregoing description. For example, the COHERA cassettes may be patterned as a mosaic of cassettes with plates of different materials, and even mixed with conventional explosive reactive armor cassettes. Furthermore, one may consider a hybrid COHERA with one plate conforming to the COHERA method and another plate being a solid steel plate as with a conventional explosive reactive armor.

The invention claimed is:

1. A controlled harm explosive reactive armor (COHERA) operative in association with a structure having an interior and an exterior, the COHERA being disposed on the exterior of the structure, comprising:

a stack of plate elements having a front plate, an intermediate plate providing a fast exothermic reaction, and a back plate, the stack of plate elements reacting explosively to disrupt the trajectory of and/or to break an incoming projectile impinging on the front plate, and at least one plate out of the stack of plate elements being configured to shatter in predetermined fragment size distribution according a selected harm prevention criteria including harm specification parameters when the COHERA reacts explosively for providing protection selected alone and in combination from the group consisting of protection to personnel in the interior of the structure, protection to the structure, and protection to personnel and/or to equipment on the exterior of the structure, whereby the COHERA forms an explosive reactive armor cassette for controlled harm prevention.

2. The COHERA according to claim 1, wherein:

at least the front plate out of the stack of plate elements is configured to shatter in predetermined fragment size distribution for defeating the incoming projectile in controlled harm prevention when the COHERA reacts explosively.

3. The COHERA according to claim 2, wherein:

a fragment distribution providing predetermined fragment size distribution for defeating the incoming projectile in controlled harm prevention upon explosive reaction of the COHERA is obtained by appropriate material selection to provide necessary fragment properties, which are selected alone and in combination, from the group of properties consisting of fragment weight, and fragment density.

4. The COHERA according to claim 1, wherein:

at least the back plate is configured to shatter in predetermined fragment size distribution for defeating the incoming projectile in controlled harm prevention when the COHERA reacts explosively.

5. The COHERA according to claim 4, wherein:

a fragment distribution providing predetermined fragment size distribution for defeating the incoming projectile in controlled harm prevention upon explosive reaction of the COHERA is obtained by appropriate material selection to provide necessary fragment properties, which are selected alone and in combination, from the group of properties consisting of fragment weight, and fragment density.

6. The COHERA according to claim 1, wherein:

the intermediate plate has at least one layer of explosive.

7. The COHERA according to claim 6, wherein:

a fragment distribution providing predetermined fragment size distribution for defeating the incoming projectile in controlled harm prevention upon explosive reaction of the COHERA is obtained by appropriate material selection to provide necessary fragment properties, which are selected alone and in combination, from the group of properties consisting of fragment weight, and fragment density.

8. The COHERA according to claim 1, wherein:

the intermediate plate has at least one layer of propellant.

9. The COHERA according to claim 8, wherein:

a fragment distribution providing predetermined fragment size distribution for defeating the incoming projectile in controlled harm prevention upon explosive reaction of the COHERA is obtained by appropriate material selection to provide necessary fragment properties, which are selected alone and in combination, from the group of properties consisting of fragment weight, fragment density and fragment shape.

10. The COHERA according to claim 1, wherein:

a fragment distribution providing predetermined fragment size distribution for defeating the incoming projectile in controlled harm prevention upon explosive reaction of the COHERA is obtained by appropriate material selection to provide necessary fragment properties, which are selected alone and in combination, from the group of properties consisting of fragment weight, and fragment density.

11. The COHERA according to claim 1, wherein:

each one plate element has at least one layer having a thickness, and the at least one layer is made of a layer substance and has a layer thickness selected to provide predetermined fragment size distribution for defeating the incoming projectile in controlled harm prevention when the COHERA reacts explosively.

12. The COHERA according to claim 11, wherein:

a plate composition for each one plate element is independent of the plate composition for each one other plate element, with respect to a plate property selected alone or in combination from the group of plate properties consisting of number of layers, sequential order of layers, and thickness of layers.

13. The COHERA according to claim 11, wherein:

at least one plate element has more than one layer of material.

14. The COHERA according to claim 11, wherein:

at least one layer of air is disposed backward of a frontmost layer of the front plate.

15. The COHERA according to claim 11, wherein:

at least one layer of air is disposed in front of a backmost layer of the back plate.

16. The COHERA according to claim 11, wherein:

the front plate and the back plate, each one alone and both in combination, are made from material having thermal insulation properties.

17. The COHERA according to claim 11, wherein:

each one plate element is configured to prevent initiation in sympathetic reaction by being selected, alone and in combination, from the group of plate material properties consisting of material type and material density.

18. The COHERA according to claim 11, wherein:

the at least one layer of either one of the front plate and the back plate is configured to provide insensitivity to initiation by shrapnel by being selected, alone and in combination, from the group of layer material consisting of layer material type and layer material density.

19. The COHERA according to claim 1, wherein the COHERA is configured to comply with at least one harm specification including a criterion related to an effect resulting from the explosive reaction for harm prevention of the COHERA.

20. The COHERA according to claim 19, wherein:

the harm specification has at least one first index including a parameter related to harm prevention.

21. The COHERA according to claim 19, wherein:

the at least one harm specification has a plurality of indices further including parameters related to additional effects resulting from the explosive reaction for harm prevention of the COHERA.

22. The COHERA according to claim 1, wherein:

the COHERA is configured to comply with a criterion having at least one parameter represented as a cell selected from a matrix of m times n cells formed by a row of harm specifications spanning from 1 to n in perpendicular to a column of index parameters ranging from 1 to m.

23. The COHERA according to claim 22, wherein:

the front plate and the back plate comply with either one of the at least one same cell and a different cell selected from the matrix of m times n cells.

24. The COHERA according to claim 22, wherein:

the front plate and the back plate comply with at least one same cell selected from the matrix of m times n cells.

25. A method for implementing a controlled harm explosive reactive armor (COHERA) cassette operative in association with a structure having an interior and an exterior, the COHERA being disposed on the exterior of the structure and having a stack of plate elements including a front plate, an intermediate plate providing a fast exothermic reaction, and a back plate, the stack of elate elements reacting explosively to disrupt the trajectory of and/or to break an incoming projectile impinging on the front plate, the method comprising the steps of:

configuring at least one plate out of the stack of plate elements to shatter in predetermined fragment size distribution according to selected harm prevention criteria including harm specification parameters when the COHERA reacts explosively for providing protection selected alone and in combination from the group consisting of protection to personnel in the interior of the structure, protection to the structure, and protection to personnel and/or to equipment on the exterior of the structure, whereby the COHERA forms a predetermined fragmentation explosive reactive armor cassette for controlled harm prevention.

26. The method according to claim 25, wherein:

at least the front plate is configured for shattering in predetermined fragment size distribution for defeating the incoming projectile in controlled harm prevention when the COHERA reacts explosively.

27. The method according to claim 26, wherein:

predetermined controlled fragmentation distribution of fragment size is obtained when the COHERA reacts explosively.

28. The method according to claim 26, wherein:

predetermined controlled distribution of fragment range is obtained when the COHERA reacts explosively.

29. The method according to claim 26, wherein:

predetermined controlled distribution of fragment shape is obtained when the COHERA reacts explosively.

30. The method according to claim 25, wherein;

at least the back plate is configured for shattering in predetermined fragment size distribution for defeating the incoming projectile in controlled harm prevention when the COHERA reacts explosively.

31. The method according to claim 30, wherein:

predetermined controlled fragmentation distribution of fragment size is obtained when the COHERA reacts explosively.

32. The method according to claim 30, wherein:

predetermined controlled distribution of fragment range is obtained when the COHERA reacts explosively.

33. The method according to claim 30, wherein:

predetermined controlled distribution of fragment shape is obtained when the COHERA reacts explosively.

34. The method according to claim 25, wherein:

the intermediate plate of the COHERA is configured to have at least one layer of explosive.

35. The method according to claim 25, wherein:

the intermediate plate of the COHERA is configured to have at least one layer of propellant.

36. The method according to claim 25, wherein:

predetermined controlled fragmentation distribution of fragment size is obtained when the COHERA reacts explosively.

37. The method according to claim 25, wherein:

predetermined controlled distribution of fragment range is obtained when the COHERA reacts explosively.

38. The method according to claim 25, wherein:

predetermined controlled distribution of fragment shape is obtained when the COHERA reacts explosively.

39. The method according to claim 25, wherein:

each one plate element is configured to have at least one layer of material having a thickness, and a material type and a material thickness are selected for the at least one layer to achieve predetermined fragment size distribution for defeating the incoming projectile in controlled harm prevention when the COHERA reacts explosively.

40. The method according to claim 39, wherein:

each one plate element is configured independently of any other plate element with respect to a number of layers and material thickness.

41. The method according to claim 40, wherein:

at least one plate element has more than one layer of material.

42. The method according to claim 40, wherein:

at least one layer of air is disposed backward of a frontmost layer of the front plate.

43. The method according to claim 40, wherein:

at least one layer of air is disposed in front of a backmost layer of the back plate.

44. The method according to claim 40, wherein:

the front plate and the back plate, each one alone and both in combination have thermal insulation properties.

45. The method according to claim 40, wherein:

the plate elements are configured to prevent initiation in sympathetic reaction.

46. The method according to claim 39, wherein:

the plate elements are configured for insensitivity to initiation by shrapnel.

47. The method according to claim 25, wherein:

the COHERA is configured to comply with at least one harm specification including a criterion related to and having an effect resulting from the explosive reaction for harm prevention of the COHERA.

48. The method according to claim 47, wherein:

the harm specification has at least one first index as a parameter related to harm prevention.

49. The method according to claim 47, wherein:

the at least one harm specification has a plurality of indices as parameters related to additional effects resulting from the explosive reaction for harm prevention.

50. The method according to claim 25, wherein:

the COHERA is configured to comply with a criterion having at least one parameter represented as a cell selected from a matrix of m times n cells formed by rows of harm specifications spanning from 1 to n in perpendicular with columns of index parameters ranging from 1 to m.

51. The method according to claim 50, wherein:

the front plate and the back plate are configured to comply with either one of both the at least one same cell and a different cell selected from the matrix of m times n cells.

52. The method according to claim 50, wherein:

the front plate and the back plate are configured to comply with at least one same cell selected from the matrix of m times n cells.

* * * * *